US006389766B1

(12) United States Patent
Jackson

(10) Patent No.: US 6,389,766 B1
(45) Date of Patent: May 21, 2002

(54) DEVICE FOR INCREASING THE STRENGTH OF SPANNING STRUCTURAL LUMBER

(76) Inventor: Charles Paul Jackson, 78 Garnet Rd., Roxbury, CT (US) 06783

( * ) Notice: Subject to any disclaimer, the term of this patent is extended or adjusted under 35 U.S.C. 154(b) by 0 days.

(21) Appl. No.: 09/517,775

(22) Filed: Mar. 2, 2000

(51) Int. Cl.[7] ..... E04G 23/02

(52) U.S. Cl. ..... 52/291; 52/223.8; 52/223.11; 52/223.14; 52/801.12

(58) Field of Search ..... 52/291, 223.1, 52/223.8, 223.12, 223.11, 223.13, 223.14, 647, 729.4, 801.12; 14/73, 74.5, 77.1; 254/104

(56) References Cited

U.S. PATENT DOCUMENTS

| | | | | | |
|---|---|---|---|---|---|
| 79,862 | A | * | 7/1868 | Ross | 52/291 |
| 778,416 | A | * | 12/1904 | Kyle | 52/223.12 |
| 2,155,121 | A | * | 4/1939 | Finsterwalder | 52/223.8 |
| 2,319,303 | A | * | 5/1943 | Crawford | 52/291 |
| 2,786,242 | A | * | 3/1957 | Stephens | 52/291 |
| 2,856,644 | A | * | 10/1958 | Dunham | 52/223.12 |
| 3,427,773 | A | * | 2/1969 | Kandall | 52/223.12 |
| 4,308,700 | A | * | 1/1982 | Romig | 52/223.8 |
| 4,704,830 | A | * | 11/1987 | Magadini | 52/223.12 |
| 5,806,259 | A | * | 9/1998 | Smith | 52/223.12 |
| 6,065,257 | A | * | 5/2000 | Nacey | 52/223.8 |

* cited by examiner

*Primary Examiner*—Carl D. Friedman
*Assistant Examiner*—Yvonne M. Horton

(57) ABSTRACT

The present invention provides a device for enhancing the load carrying capacity of new or existing, spanning, structural lumber. The device consists of a perforated steel strap, attached at both ends of a spanning structural member by means of standard fasteners such as nails, screws or bolts and running parallel to the long axis of the member either on the bottom or along the side. The strap is then tensioned by means of a central expanding device such as opposed wedges. The tensioning of the strap has the effect of adding tensile strength to the bottom chord of the spanning structural member as well as supporting the center of the member, thereby increasing the load carrying capacity. The device could be attached to new structural lumber before installation to either reduce the size of the member needed for a given span or to increase the spanning capacity for a given size of lumber. In existing construction the device could be added to the bottom or sides of structural members already installed to increase their load carrying capacity.

16 Claims, 4 Drawing Sheets

DEVICE FOR INCREASING THE STRENGTH OF SPANNING STRUCTURAL LUMBER

BACKGROUND OF THE INVENTION

The present invention was conceived as a repair to a bouncy floor problem in the inventor's home. The dining room of the inventor's home is supported by typical framed construction with nominal 2 inch×10 inch Douglas Fir floor joists spaced 16 inches on center to carry the floor load. One of the floor joists was noticeably weaker than the others due to large knots and grain flaws and allowed an undesirable amount of deflection in that area of the floor when stepped on.

The deflection was removed by attaching a perforated steel strap to the underside of the weak joist at each end and tensioning said strap with opposed wedges at the center of the span. The strap and wedge combination provided additional tensile strength to the bottom chord of the weak joist as well as support to the center span area where the wedges pressed up against the bottom of said joist. After application of the invention the weak floor joist no longer deflected under normal floor loads, and was in fact more rigid than other joists adjacent to it.

Other beam strengthening devices are illustrated in U.S. Pat. Nos. 2,856,644; 3,427,773; and 5,806,259. It becomes evident from review of the known devices that while they rely on the same principles of physics as the present invention to strengthen the beam, they are substantially more complex, more difficult to install and more expensive to manufacture. Furthermore, none of the prior art utilizes a perforated flat metal strap, which is inherently easy to attach to the beam. Additionally none of the prior art has the simple tensioning devices claimed in the present invention or the flexibility of the present invention, which could be sold in bulk and cut to appropriate lengths on the work site.

The object of the present invention is to provide a simple, low cost means of strengthening spanning structural wood members. The invention has applications in the strengthening of existing spanning members such as inadequate joists or rafters already in place in a structure. The invention could also be used to increase spans or reduce the size of spanning wood members in new construction. Another application might be in a pre-manufactured truss-beam combination. The inventor has been engaged in the construction of wood frame buildings for over 27 years and has seen no prior art that utilizes a tensioned steel strap to strengthen a spanning wood member.

SUMMARY OF THE INVENTION

The present invention provides a device for enhancing the load carrying capacity of new or existing, spanning, structural lumber. The device consists of a steel strap, attached at both ends of a spanning structural member by means of standard fasteners such as nails, screws or bolts and running parallel to the long axis of the member either on the bottom or along the side. The strap is then tensioned by means of a central expanding device such as opposed wedges, or a screw device. The tensioning of the strap has the effect of adding tensile strength to the bottom chord of the spanning structural member as well as supporting the center of the member.

DESCRIPTION OF THE PREFERRED EMBODIMENT OF THE INVENTION

The present invention provides a simple, low cost device for enhancing the load carrying capacity of new or existing spanning structural lumber as illustrated in FIGS. 1–10 of the drawings. The device is constructed from known elements, several of which are already used in the construction industry.

Figure 1:
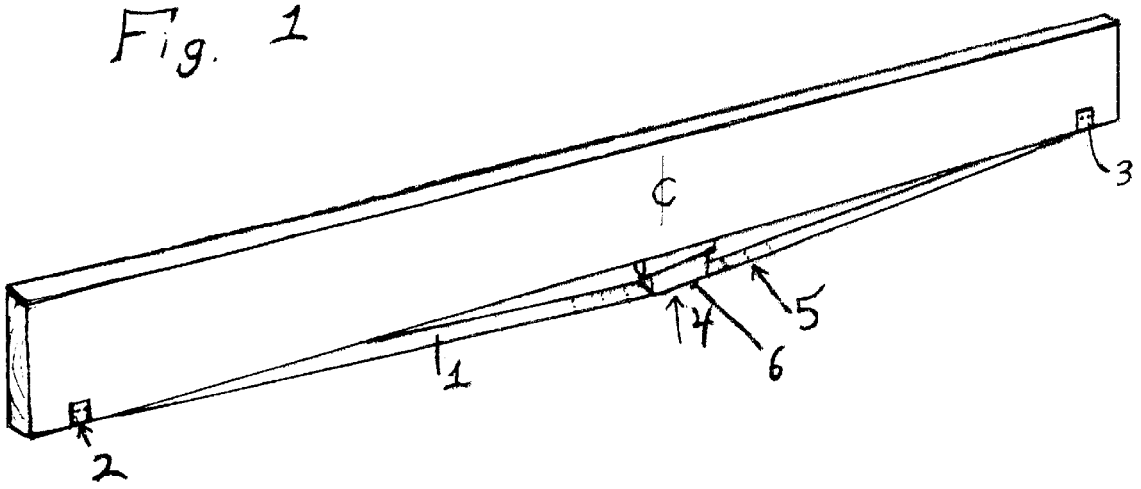
FIG. 1. is a perspective view of one embodiment of the device as originally conceived and attached to a typical spanning wood member.

FIG. 1 discloses the device as attached to a typical wood structural member oriented to carry a load in span. The device consists of a perforated steel strap as indicated by reference numeral 1, with said perforations indicated by numeral 5, attached to the bottom of said structural member with standard known fasteners, such as nails or screws at end points indicated by reference numerals 2 and 3. Said strap is tensioned at the center of the span by sliding opposed wedges as indicated by numeral 4, which are held in place by wood screws or similar fasteners inserted upwards through the perforations at a point indicated by numeral 6, to simultaneously attach the device to the bottom of the structural member and prevent the opposed wedges from sliding backwards.

Figure 2:
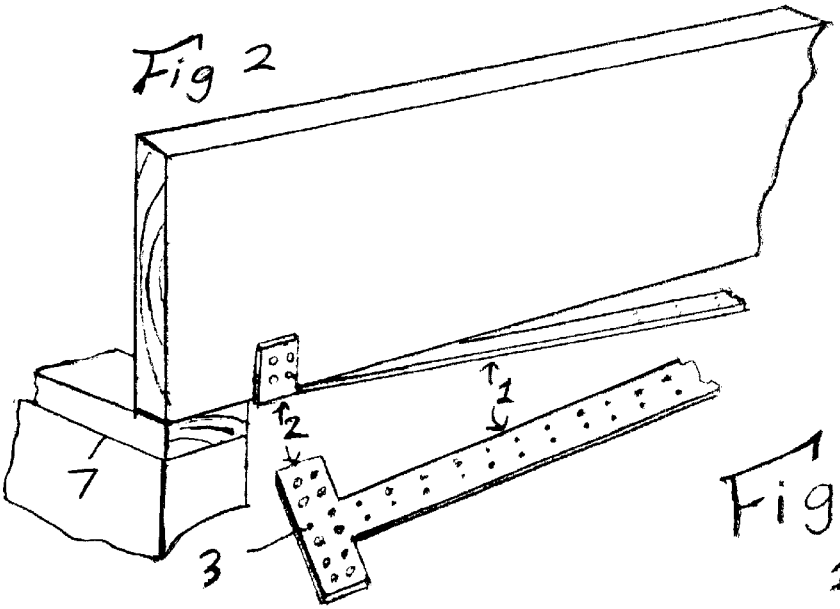
FIG. 2. is a perspective detail showing one end of the device of FIG. 1 with a separate view of the end of the strap before installation.
Figure 3:
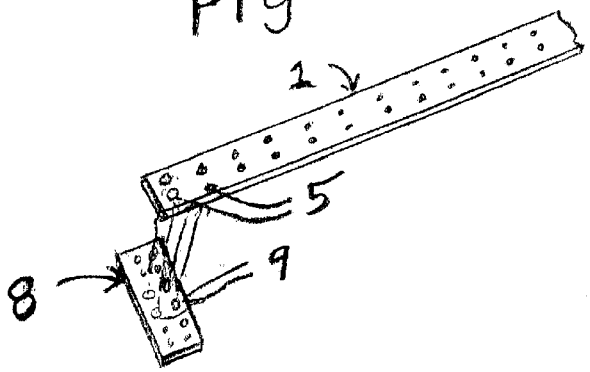
FIG. 3. is a perspective view of a variation of the strap in FIG. 2 in which the strap is composed of two pieces of the same material for ease of production.

As more clearly illustrated in FIG. 2, the strap is attached to the end of the spanning member adjacent to a typical bearing member 7 which supports said spanning member. FIG. 2 also shows greater detail of the strap which is perforated evenly throughout its length and could be produced with an attached T shaped end 3 to provide adequate holes for fastening, or as illustrated in FIG. 3, the end could be composed of a separate end piece 8, having symmetrical holes 9, that align with corresponding symmetrical holes in the strap 1, at points 5, with connection of said end piece 8 and strap 1 being achieved by insertion of standard fasteners, such as nails or screws, through said holes 9 and 5 and into the wood member. Said end piece 8 could be the same material as the strap 1 and both could be mass produced and sold in bulk to be cut by artisans in the field into appropriate lengths corresponding to the length of the span and end pieces as required.

Figure 4:
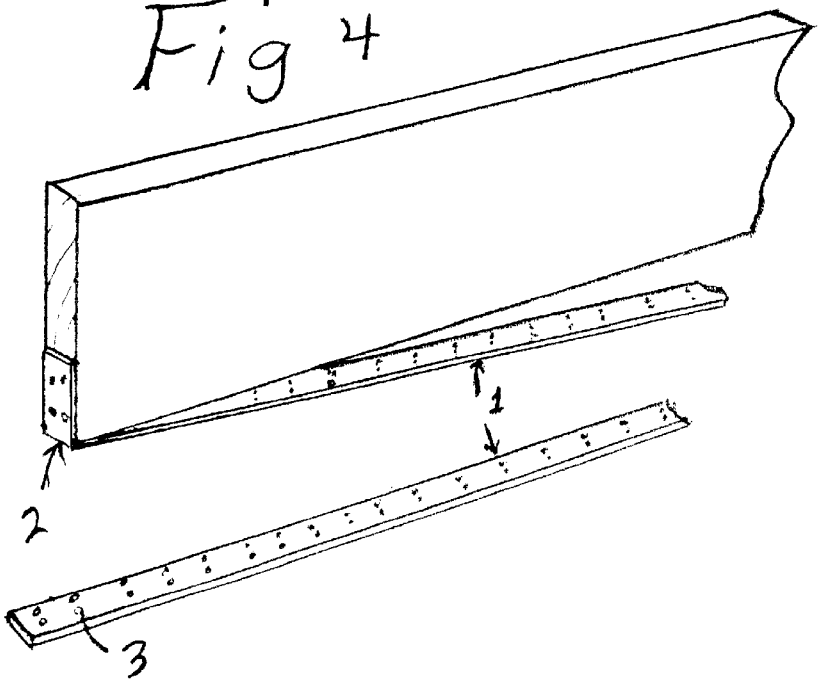
FIG. 4. is a perspective view of a variation of the strap as attached to the end of a new beam before installation.

FIGS. 2 and 3 also illustrate the preferred embodiment of the invention for installation in existing structures where the device would be attached to an existing spanning member at point 2 next to a typical existing bearing member 7. Alternatively, FIG. 4 illustrates an installation in new construction where the perforated strap 1 is bent around and attached to the end of the wood member at point 2 prior to installation, while the end of said member is still accessible. Attachment thus indicated in FIG. 4 would simplify installation and eliminate the need for the T shaped end in FIG. 2 and 3.

Figure 5:
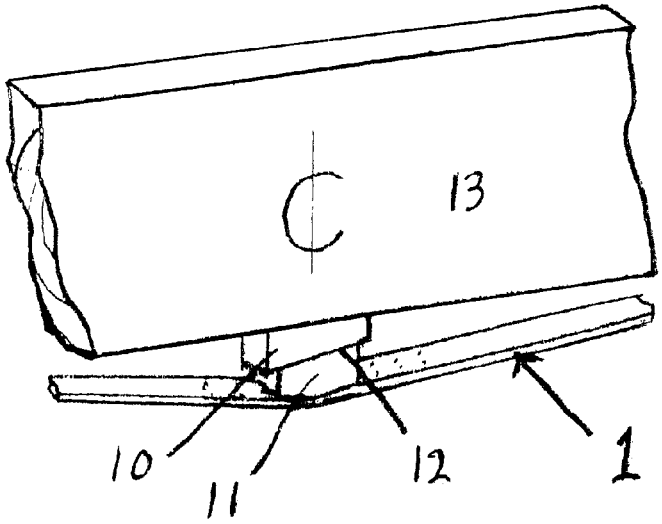
FIG. 5. is a perspective view providing enlarged detail of the device of FIG. 1 showing the opposed wedges used to tension the steel strap.
Figure 6A:
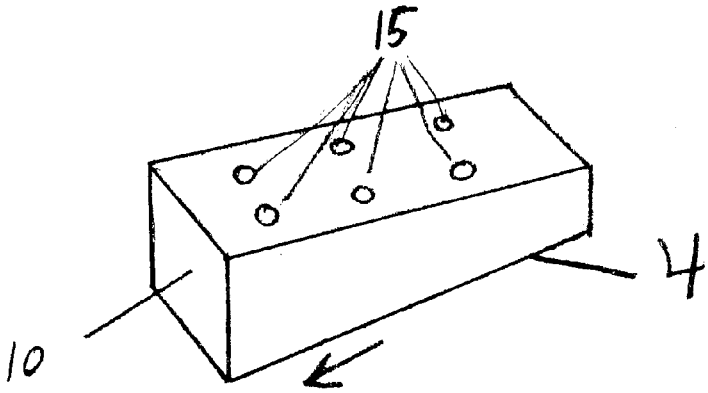
FIG. 6A. is a perspective view showing detail of the beam side opposed wedge of the tensioning portion of the device of FIG. 5.
Figure 6B:
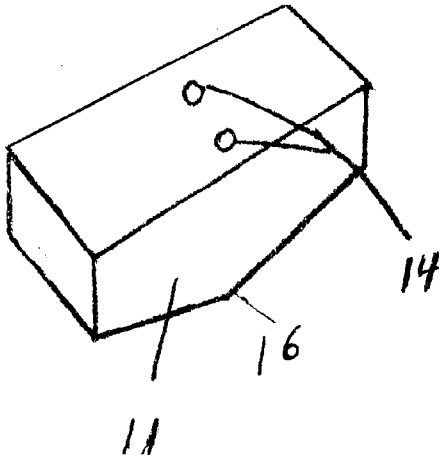
FIG. 6B. is a perspective view showing detail of the strap side opposed wedge of the tensioning portion of the device of FIG. 5.

After the strap is attached to both ends of the spanning member, the strap would then be tensioned at the approximate center of the span as illustrated in FIG. 5, which shows the preferred embodiment of the invention with a tensioning device consisting of opposed wedge 10 and opposed wedge 11, which are slidable along a common inclined plane 12, thereby expanding their combined width to tension strap 1 and support the center of the spanning member 13. In the preferred embodiment of the invention said wedges 10 and 11 would be produced with pre-drilled holes that correspond dimensionally to holes in the strap and each other as illustrated in FIGS. 6A and 6B which provide greater detail of the blocks of FIG. 5 and further show in FIG. 6B holes at 14 in block 11, which would be aligned during the tensioning process with one set of the corresponding holes 15 shown in FIG. 6A in block 10. Block 11 in FIG. 6B would also have a peak 16 provided to approximate the bend in said strap at the center of the span.

Figure 7:
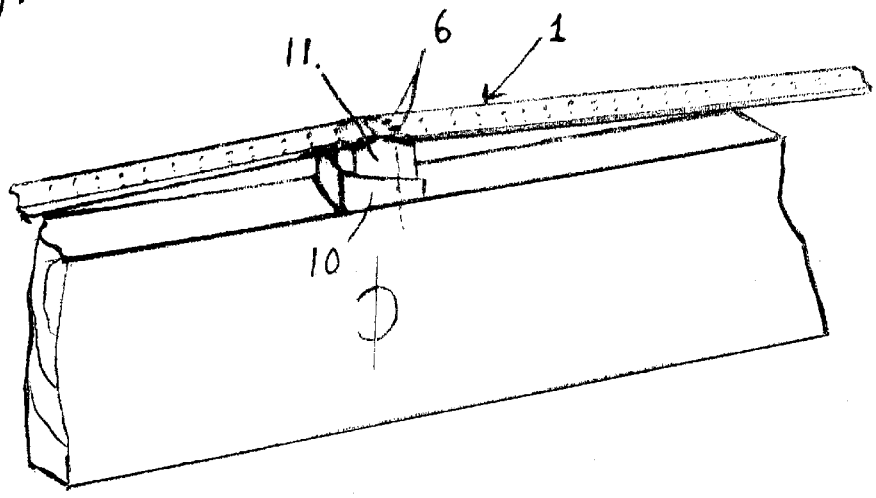
FIG. 7. is an upside-down perspective view of the tensioning portion of the device of FIG. 5 illustrating the attachment and locking in place of the opposed wedges with standar wood screw fasteners.
Figure 8:
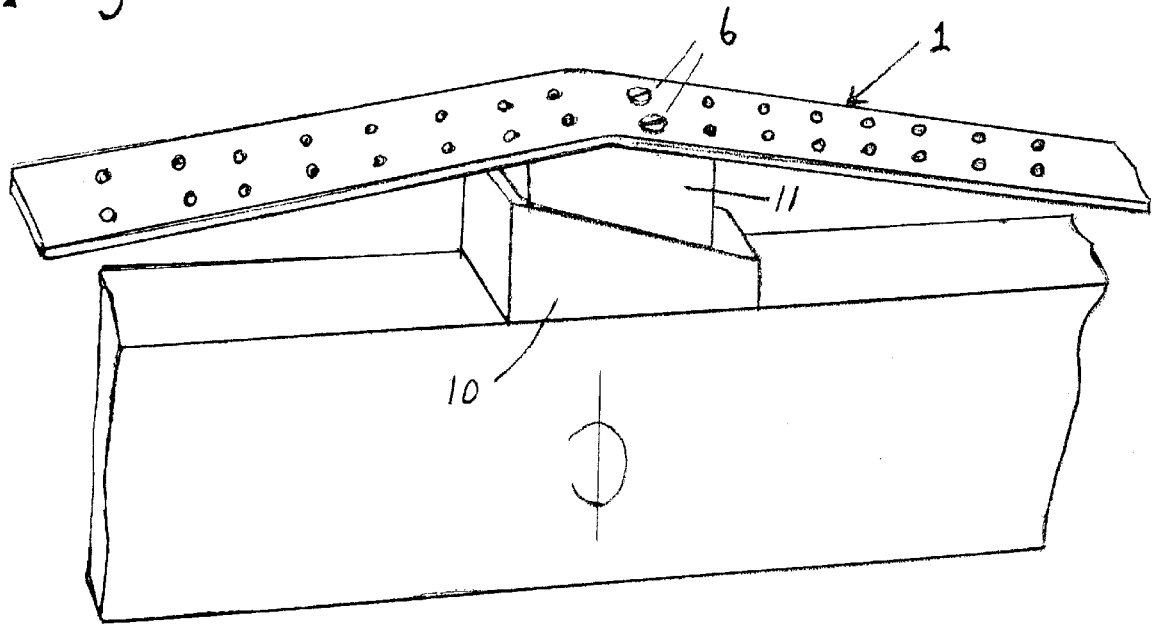
FIG. 8. is an enlargement of the perspective view of FIG. 7 showing one embodiment of the device having removable screws.

The tensioning device is further illustrated in FIGS. 7 and 8, which provide upside down views of the tensioning device of FIGS. 5, 6A and 6B, to more clearly illustrate how fasteners 6 are inserted through the strap 1, then through blocks 10 and 11 and then into the bottom of the spanning wood member at its approximate center.

It is believed that other modifications of the embodiments described herein will become apparent to those of skill in the art. However, the above discussion has been intended to be illustrative only, and not restrictive of the scope of the invention, that scope being defined by the following claims and all equivalents thereto:

I claim:

1. A device to be attached to the bottom of a spanning structural wood member, said device including:

a metal strap adapted to be attached parallel to the long axis of said structural member at both ends with known standard end fasteners;

opposed wedges for insertion between said metal strap and the spanning wood member at the approximate center of the span to tension said metal strap, thereby adding tensile strength to the bottom of the structural wood member as well as support at the center of said span for increasing the spanning capacity of the structural wood member.

2. A device as claimed in claim 1 utilizing a perforated metal strap adapted to be attached at both ends of said structural member with known standard fasteners, wherein said opposed wedges are perforated for being held in place after tensioning of said strap with known standard fasteners adapted to be inserted through the holes in said perforated strap and corresponding holes aligned in said wedges.

3. The device of claim 2, wherein said known standard fasteners adapted to be inserted in said wedges are screws or nails.

4. The device as in claim 1, wherein said opposed wedge adjacent to said metal strap includes a peak for approximating a bend in said strap at said center of said strap for reducing load points and material failure.

5. The device as claimed in claim 1, wherein said known fasteners are screws, nails or bolts.

6. The device as claimed in claim 1, wherein said opposed wedges are made of incompressible material.

7. The device as claimed in claim 1, wherein said opposed wedges are made of wood, plastic, or metal.

8. A device for adding tensile strength to a structural member, comprising:

a metal strap adapted to be attached parallel to a bottom surface of the structural member; and opposed wedges for insertion between the metal strap and the structural member at a center thereof to add support, tensile strength, and increase the spanning capacity of the structural member.

9. A pre-manufactured structural wood member including:

a metal strap attached at both ends of said metal strap with end fasteners, said metal strap approximately parallel to the long axis of said structural member;

opposed wedges for insertion between said metal strap and said structural wood member at the approximate center of the structural wood member for tensioning said metal strap and increasing the spanning capacity of said structural wood member.

10. The pre-manufactured structural wood member as defined in claim 9, wherein said end fasteners are screws, nails or bolts.

11. The pre-manufactured structural wood member as defined in claim 9, wherein:

said metal strap has perforations for inserting wedge fasteners; and said opposed wedges have perforations for aligning with said perforations in said metal strap for inserting said wedge fasteners through said perforations in said metal strap and into corresponding perforations in said opposed wedges for holding said opposed wedges in place after tensioning said metal strap.

12. A method of adding tensile strength to a bottom of a structural wood spanning member, comprising the steps of:

providing a metal strap having end portions for attaching to longitudinally spaced areas of the spanning structural wood member;

providing opposed wedges for tensioning said metal strap;

attaching said metal strap approximately parallel to a long axis of the spanning structural wood member at both ends with end fasteners;

inserting opposed wedges between said metal strap and the spanning structural wood member at a midpoint between end portions of said metal strap for tensioning said metal strap, thereby adding tensile strength to a bottom of the spanning structural wood member as well as support at a center of the spanning structural wood member.

13. The method of claim 12, further comprising the step of:

holding said opposed wedges in place by inserting fasteners through said metal strap and into said opposed wedges.

14. The method of claim 13, further comprising:

inserting said fasteners through said opposed wedges into the spanning structural wood member.

15. The method of claim 12, wherein:

said metal strap has perforations for inserting fasteners; and said opposed wedges have perforations for inserting said fasteners; and further comprising holding said opposed wedges in place by aligning said perforations in said metal strap with said perforations in said opposed wedges, and inserting fasteners through said perforations in said metal strap into said perforations in said opposed wedges.

16. The method of claim 15, further comprising inserting said fasteners through said opposed wedges into the spanning structural wood member.

* * * * *